US005709015A

United States Patent [19]

Denti et al.

[11] Patent Number: 5,709,015

[45] Date of Patent: Jan. 20, 1998

[54] AUTOMATED PILE-RAISING MACHINE FOR FABRIC

[75] Inventors: Alessandro Denti; Paolo Fedi, both of Prato, Italy

[73] Assignees: Comet S.p.A., Di Montemurlo; Sperotto Rimar S.p.A., Milan, both of Italy

[21] Appl. No.: 702,618

[22] PCT Filed: Dec. 30, 1995

[86] PCT No.: PCT/EP95/05182

§ 371 Date: Aug. 30, 1996

§ 102(e) Date: Aug. 30, 1996

[87] PCT Pub. No.: WO96/21059

PCT Pub. Date: Jul. 11, 1996

[30] Foreign Application Priority Data

Jan. 3, 1995 [IT] Italy ..... MI95A0004
Aug. 25, 1995 [IT] Italy ..... MI95A1804

[51] Int. Cl.[6] ..... D06C 11/00

[52] U.S. Cl. ..... 26/33; 26/34

[58] Field of Search ..... 26/29 R, 33, 34, 26/35, 70, 32, 79; 364/470.01, 470.14

[56] References Cited

U.S. PATENT DOCUMENTS 4,073,043 2/1978 Lowder ..... 26/33

FOREIGN PATENT DOCUMENTS 91 01 604 5/1991 Germany .

*Primary Examiner*—Amy B. Vanatta
*Attorney, Agent, or Firm*—Cushman Darby & Cushman IP Group of Pillsbury Madison & Sutro LLP

[57] ABSTRACT

An automated pile-raising machine for fabric, in which the fabric is advanced about at least one drum, in contact with alternatingly interspersed pile and counter-pile rotating cylinders cleaned by respective cleaning brushes, a timing control system including sensors is provided for coordinating operation of the cylinders and brushes.

24 Claims, 5 Drawing Sheets

AUTOMATED PILE-RAISING MACHINE FOR FABRIC

This application claims benefit of international application PCT/EP95 /05182, filed Dec. 30, 1995.

BACKGROUND OF THE INVENTION

The present invention relates to an automated pile raising machine for fabric.

Pile-raising is a process giving a fabric a hairy, velvet-like appearance while simultaneously increasing the softness and heat insulating, as well as colour, characteristics thereof.

In raising machines, in particular in raising machines with metal trimmings, cleaning brushes are provided which are suitable for cleaning and sharpening the trimmings of pile and counter-pile cylinders. In particular, at least one pair of brushes must be provided, one of which can act on the trimmings of the raising pile cylinders, and the other on the trimmings of the counter-pile cylinders. In order to correctly perform such cleaning and sharpening tasks, the brushes are required to revolve perfectly in phase with the respective cylinders.

At present, this necessary timing of rotation of brushes and pile and counter-pile cylinder sets is accomplished by providing various types of mechanical transmission means, e.g., constituted by chains, toothed belts, gear wheels or sprocket wheels, or the like, between the pulleys or sprocket wheels of the motor means driving the revolving drum, and pulleys arranged integral with the shafts of the brushes.

The above structure results, for example owing to the natural arising of clearances in chain meshes, in rupture of belt and gear wheel teeth, and so forth, in the possibility of sudden loss of timing and/or motion transmission between the parts. Or, the loss can be also caused by external events, such as wear or improper service.

Although sometimes also a sensor is provided which in a relatively short time can cause the revolution-driving motor means to be stopped, the processed fabric gets often wound on the brushes, which remain in contact with the raising cylinders, with consequent damaging and blocking which imply long dead times of the whole raising machine.

Furthermore, it may happen that the cleaning brushes revolve out-of-phase relative to the drum, until they cause the irreparable damaging of the needles and metal points installed on the surfaces of brushes and cylinders.

A first minor remedy, however not so effective, is constituted by the presence of clutch means between the transmission means which transmit the revolutionary motion to the brushes, and the same brushes, which may slide by an angle of 180° on an average, or, at maximum, corresponding to a complete revolution between the parts. However, in any case, fabric winding on the brushes may still occur in case of missed timing of the revolving elements.

A second type of remedy to limit the damage in the case lack of synchronism is constituted by a torque-limiting coupling, which rapidly acts on the cleaning brushes. Unfortunately, as a rule, regulating such a coupling is rather complex, because the intervention threshold torque value must be set by taking into account both the (relatively high) starting-up torque and the steady-state operating torques, which are considerably lower than the starting-up torques.

Furthermore, the presence of the above-cited transmission means implies, as a natural consequence thereof, a certain structural and maintenance complexity of the raising machine.

It should also be underlined that, should the brush/drum cylinder timing have to be changed, a whole series of changes in parts arrangements and adjustments and regulation operations must be carried out, possibly including all those mentioned above, with considerable increases in production costs due to machine dead times and lack of automation and reliability as to the correct execution of requests and necessary changes.

SUMMARY OF THE INVENTION

The purpose of the present invention is of providing a raising machine, in particular with metal trimmings, which does not display any of the above-cited drawbacks.

A further purpose is of providing a raising machine of the above-cited type which reduces as extensively as possible the need for interventions and in a nearly automatic way performs the several functions of correct motion transmission and mutual timing of the parts, while avoiding any possible types of damaging of its structural parts.

The adoption of single motor means or electrical motor units associated with the drum and at least one of the cleaning brushes, all of them being piloted by an electric-electronic system, makes possible the necessary timing to be accomplished with getting rid of the traditional toothed pulley transmission means with the relevant gear wheels which, as said, do not secure the necessary reliability.

It is important to observe that the timing existing in a machine according to the present invention is not rigidly fixed forever, as, on the contrary, the case is for the traditional machines using the torque limiting coupling.

On the contrary, in the machine according to the present invention, one can rapidly and finely act on synchronization. This is particularly useful in those cases when fabric penetrates between the drum and the cleaning brushes, owing to slowing-down, tearing or breakage of the same fabric.

Moreover, the elimination of the torque limiting coupling contributes to render the structure of the raising machine of the present invention still simpler and hence cheaper.

BRIEF DESCRIPTION OF THE DRAWING

The characteristics and advantages of an automated raising machine according to the present invention will be clearer from the following exemplifying, non-limitative disclosure, made by referring to the accompanying schematic drawings, in which.

DETAILED DESCRIPTION

Figure 1:
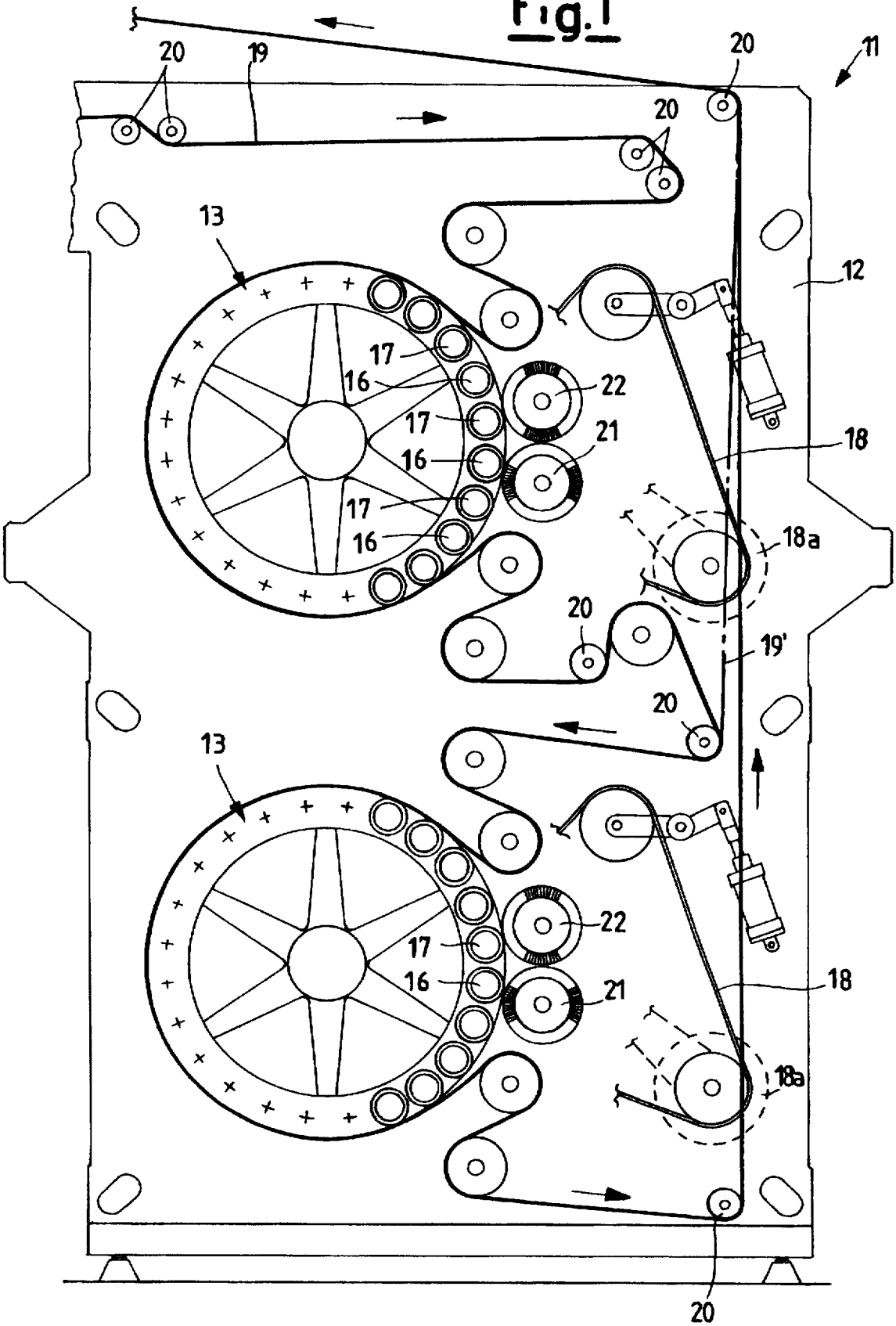
FIG. 1 shows a cross-sectional view of a first exemplifying embodiment of a raising machine according to the present invention, having two mutually superimposed drums.
Figure 2:
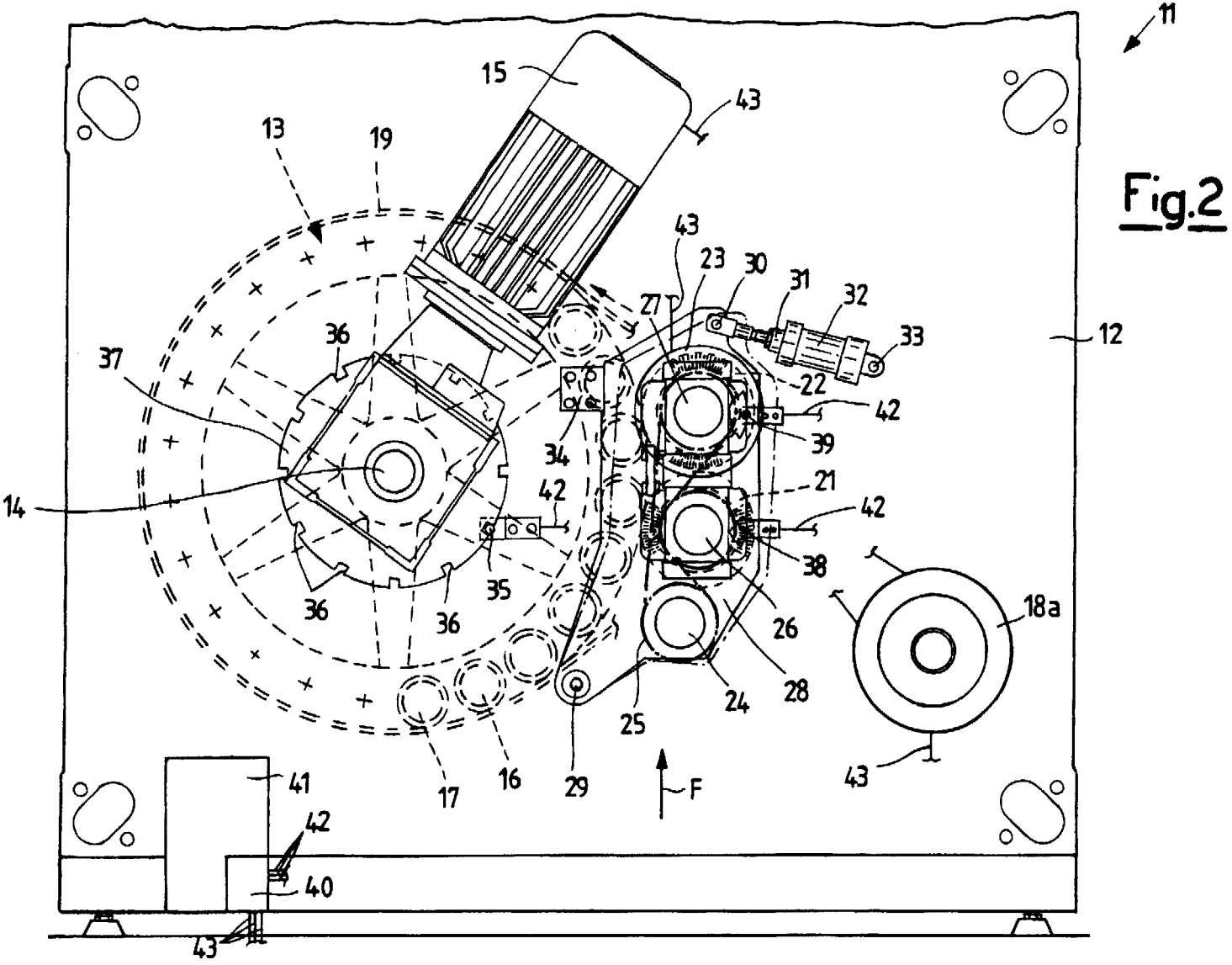
FIG. 2 shows an enlarged side view limited to the area of the lower drum and to the brush bearing plate of the machine shown in FIG. 1.
Figure 3:
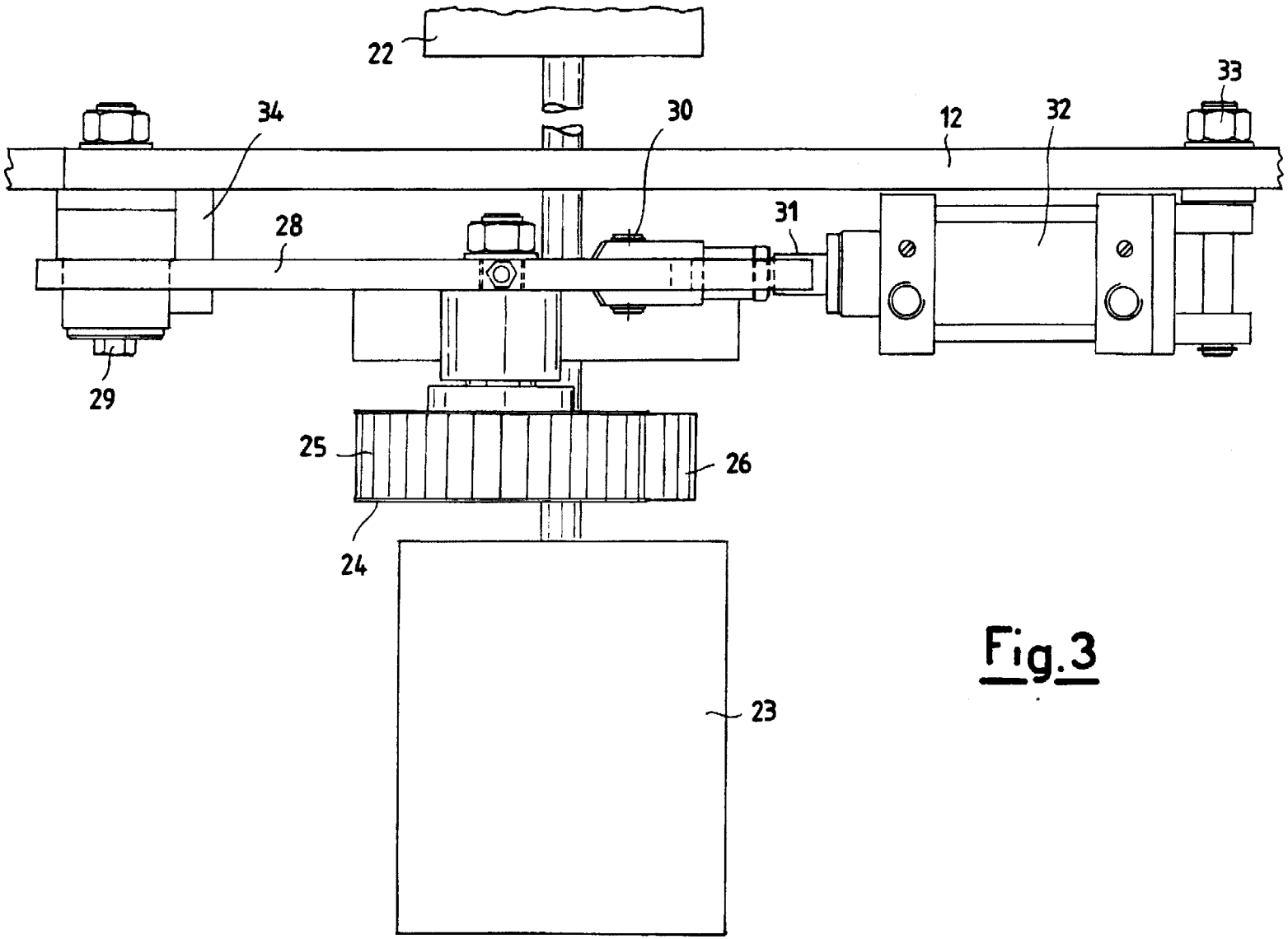
FIG. 3 shows an enlarged bottom plan view according to arrow "F" of FIG. 2, of the only brush bearing plate.

Referring first to FIGS. 1–3, a possible—however, non-limitative—embodiment is shown, of an automated pile raising machine for fabric according to the present invention.

This exemplifying embodiment illustrates a raising machine of the type having two mutually superimposed drums; however, of course, the raising machine of the present invention may be of the single-drum type or in-line multiple-drums-type as well.

FIG. 1 schematically illustrates a raising machine having two mutually superimposed drums, generally indicated by (11), in which, on a carrier/housing structure indicated in figure by a side wall (12), two drums (13) are supported/housed. These drums (13) revolve around shafts (14) driven to revolve by a respective motor means or ratiomotor means (15) and each of them supports a set of raising, or processing, cylinders, respectively operating in pile mode (16) and in counter-pile mode (17), arranged according to drum generatrices and mutually alternating.

The cylinders (16) and (17) are driven to revolve, by mutually independent drive means according to mutually independent revolution directions by transmission means schematically indicated at (18) and motor-driven at 18*a*).

A fabric to be processed, schematically indicated at (19), which unwinds from a feed roll, not shown in figure, is fed to the raising machine and, running on return rollers (20) and other devices, comes to the surface of the first drum (13). Here, the fabric runs on the pile (16) and counter-pile (17) processing cylinders, revolving in opposite directions. After leaving the first drum (13), the fabric runs along a similar path on the second, underlying drum (13) before leaving the machine and being sent, e.g., to a new roll winding. Further alternative paths, e.g., on one single drum (13), are indicated in phantom line at (19').

At that zone of the side surface of the drum in which the pile and counter-pile raising cylinders (16) and (17), respectively, are not in contact with the fabric (19), a pair of brushes (21) and (22) are arranged. The brushes (21) and (22) perform the task of cleaning and sharpening the trimmings provided on the raising cylinders (16) and (17). At each drum (13), the brush (21) acts on a set of pile cylinders (16) and the brush (22) acts on a set of counter-pile cylinders (17).

In a machine according to the present invention, a motor means, schematically indicated at (23), controls and regulates the angular speed, e.g., of the brush (22). In fact, the motor means (23) is directly constrained onto the shaft of the brush (22) to which also a sprocket wheel (27) is keyed. On the latter, a toothed belt (25) winds around which is suitable for transmitting the revolution motion also to a second sprocket wheel (26) which is integrally arranged onto the shaft of the second brush (21).

Furthermore, the toothed belt (25) winds around a third sprocket wheel (24), which regulates the tension of the toothed belt (25). It should be observed that the toothed belt (25) winds around the sprocket wheels (26) and (27) on opposite sides thereof, so as to cause the brushes to revolve in mutually opposite directions. In fact, the brushes (21) and (22) are required to revolve in phase in the revolution direction of the respective cylinders (16) and (17).

Furthermore, according to the present invention, it should be understood that both the ends of the sprocket wheels (26) and (27) carrying shafts and the respective brushes (21) and (22) and the third sprocket wheel (24) are supported on a plate (28).

This plate (28) is of an elongated shape which approximately follows the circular outline of the side surface of the drum (13) and, at one of its ends is hinged, at (29) onto the side wall (12) of the carrier structure of the raising machine. At its other end, the plate is hinged in (30) onto the end of a stem (31) of the ram of a cylinder (32), which is rotatably hinged, at (33), onto the side wall (12).

FIG. 2 shows, in solid line, the position in which the stem (31) of the ram of the cylinder (32) is extended outwards so as to cause the plate to come into engagement with a shoulder element (34) which is integral with the side wall (12) and consequently cause the respective brushes (21) and (22) to come into engagement with the respective pile (16) and counter-pile (17) cylinders. Clearly, when the stem (31) gets retracted inside the cylinder (32), the plate (28) gets so rotated as to cause the brushes (21) and (22) to move away from the raising cylinders of the respective drum (13), as is schematically illustrated in phantom line in FIG. 2.

FIG. 3 clarifies to a greater extent the positioning of the motor means (23) on the shaft of the brush (22), the hinging (29) of the plate (28) onto the side wall (12), and the positioning of the cylinder (32) used in order to cause the plate (28) to swing.

From FIG. 2, one will furthermore see the presence of a set of sensors which detect, instant-by-instant, the angular position of the drum and of the brushes. In fact, a first sensor (35) is provided so as to be integral with the side wall (12), and is suitable for detecting, e.g., a plurality of notches (36) provided on a plate (37) integrally revolving with each of drums (13). Clearly, the number of notches is correlated with the number of raising cylinders provided on the drum (13).

A second sensor (38) and a third sensor (39) are installed on the plate (28) so as to detect relevant notches provided, as in the preceding case, on plates, integrally revolving with both brushes (21) and (22), so as to check the angular position thereof.

The three sensors (35), (38) and (39) are, of course, connected, through connecting lines (42), with an electronic apparatus, which is schematically shown at (40), which detects the signals. Due to the presence of a processor, schematically depicted in (41), the electronic equipment (40) verifies the predetermined timing of the several revolving elements, i.e., of their drive motor means, through connecting lines (43). In that way, a perfectly timed correlation is realized between the drum, or the raising rollers thereof, and the brushes designed to interact on the raising rollers The presence of sensors (38) and (39) allows, in the event when a lack of cylinders/brushes timing is detected, the electronic equipment (40) to immediately intervene, by causing the cylinder. (32) to retract the stem (31) and consequently cause the brushes (21) and (22) to get disengaged from the raising cylinders (16) and (17). In that way, the fabric is prevented from winding around the brushes, thus avoiding burdensome machine stops and damage possibilities. This disengagement takes place also in the event of electrical and/or pneumatic power supply interruption.

Briefly, operation of the raising machine according to this first embodiment (FIGS. 1–3) of the present invention is as follows.

In the illustrated example, at starting-up time, the raising machine has its plate (28) so positioned that the brushes (21) and (22) are disengaged from the raising cylinders (16) and (17) of the drum (13). Upon machine enabling, the drum starts revolving, driven by its motor means (15), while the pair of motors (18*a*) with transmission means (18) cause both groups of raising cylinders (16) and (17) to start revolving. The motor means (23) drives the brushes (21) and (22) to revolve, and the correct timing of brushes, drum, and drum raising cylinders is immediately checked by means of sensors (35,38,39). In case of positive result, the plate (28)

is pushed to rotate by the ram/cylinder (32) and the brushes get engaged with the respective raising cylinders. This check continues throughout machine running, at each revolution of the brushes, so that, when an incorrect timing is detected, the plate is caused to immediately return back to its initial (start-up) position, with the brushes and raising cylinders getting consequently disengaged.

The advantage clearly emerges of such an inventive technical solution, in which the disengagement is not enabled following mechanical breakages, and in any case the above-cited disengagement is accomplished, with the drawbacks which affect the machines known from the prior art being completely overcome.

This possibility of stopping and moving the brushes away from the drum is particularly important in the event when the fabric winds around and is caught by the brushes. In fact, any risk of damage to the metal trimmings and to the same cylinders is avoided. Furthermore, advantageously, no clutches have to be installed between the transmission means which transmit the revolutionary motion to the brushes and the same brushes, with the structure of the machine being simplified.

One should observe that the motor means (23) which determines the control and regulation of the angular speed can be a stepper motor, a brushless motor, a drive system with an inverter, or the like.

In the same way, in the disclosed and illustrated exemplary embodiment, a transmission by a toothed belt is provided between both brushes; however, in an equivalent way and without departing from the scope of the present invention, either two gear wheels keyed on the shafts of the respective brushes, or a chain transmission, or similar means can be provided.

One can even think of installing on each brush a respective motor means, thus eliminating any problems associated with incorrect transmission timing, and electronically correlating the rotation of both motor means.

The presence of sensors operatively connected with the electronic equipment makes furthermore possible a nearly immediate and automatic timing to be accomplished of the brushes and drum cylinders, e.g., in the event when the operating direction of the machine must be rapidly changed. Thus, mechanical elements to be actuated in case of brushes and drum rotation changes are got rid of with an automatically reversible machine with drums operating in both directions being provided.

The elimination of the transmissions—which, on the contrary, are provided in the presently used raising machines—besides increasing timing reliability, allows the necessary machine servicing to be sharply reduced. Of course, also manufacturing the various component parts is considerably simplified by the elimination of the components of the several transmissions.

Figure 4:
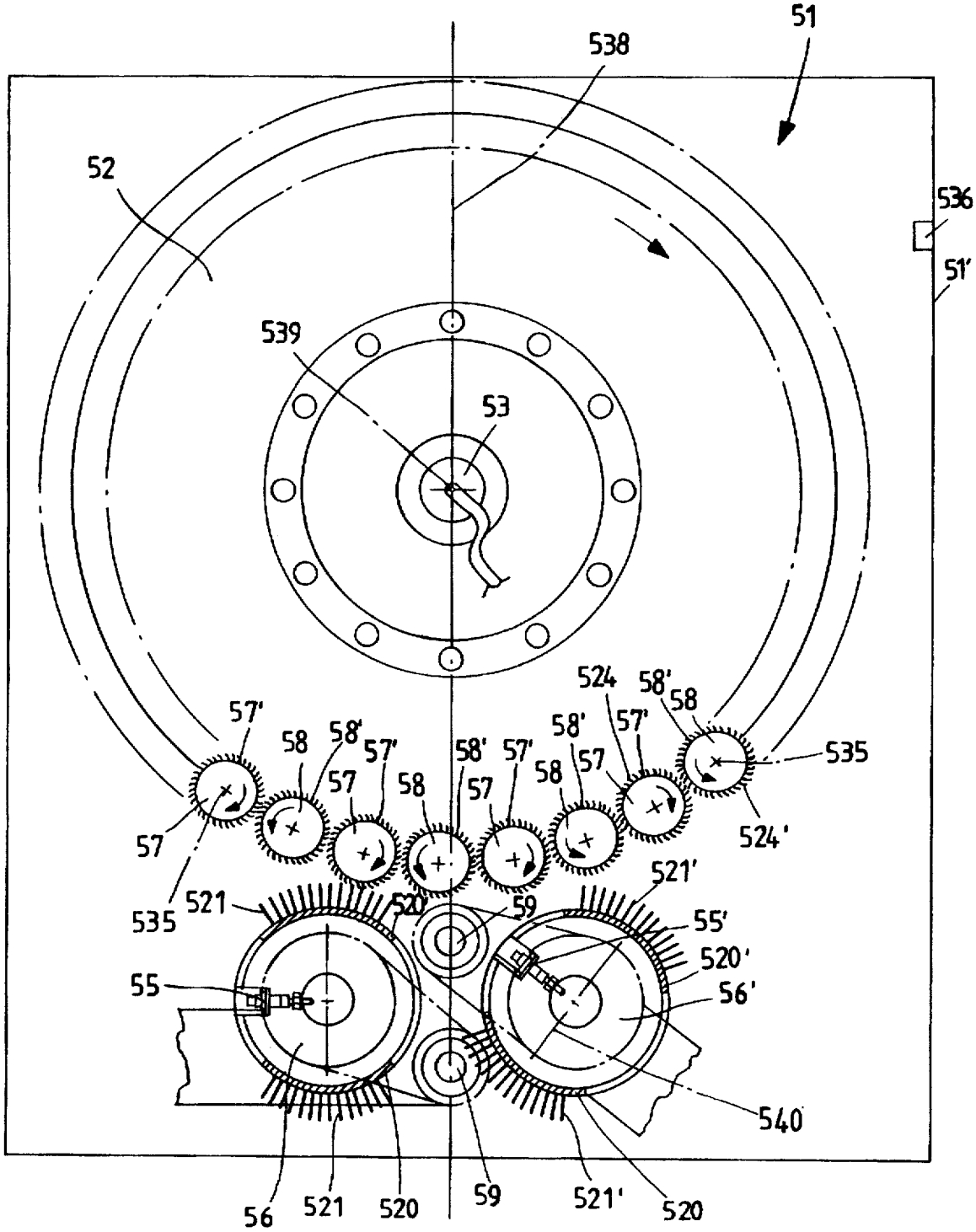
FIG. 4 shows a schematic front view of a second embodiment of the raising machine according to the present invention.
Figure 5:
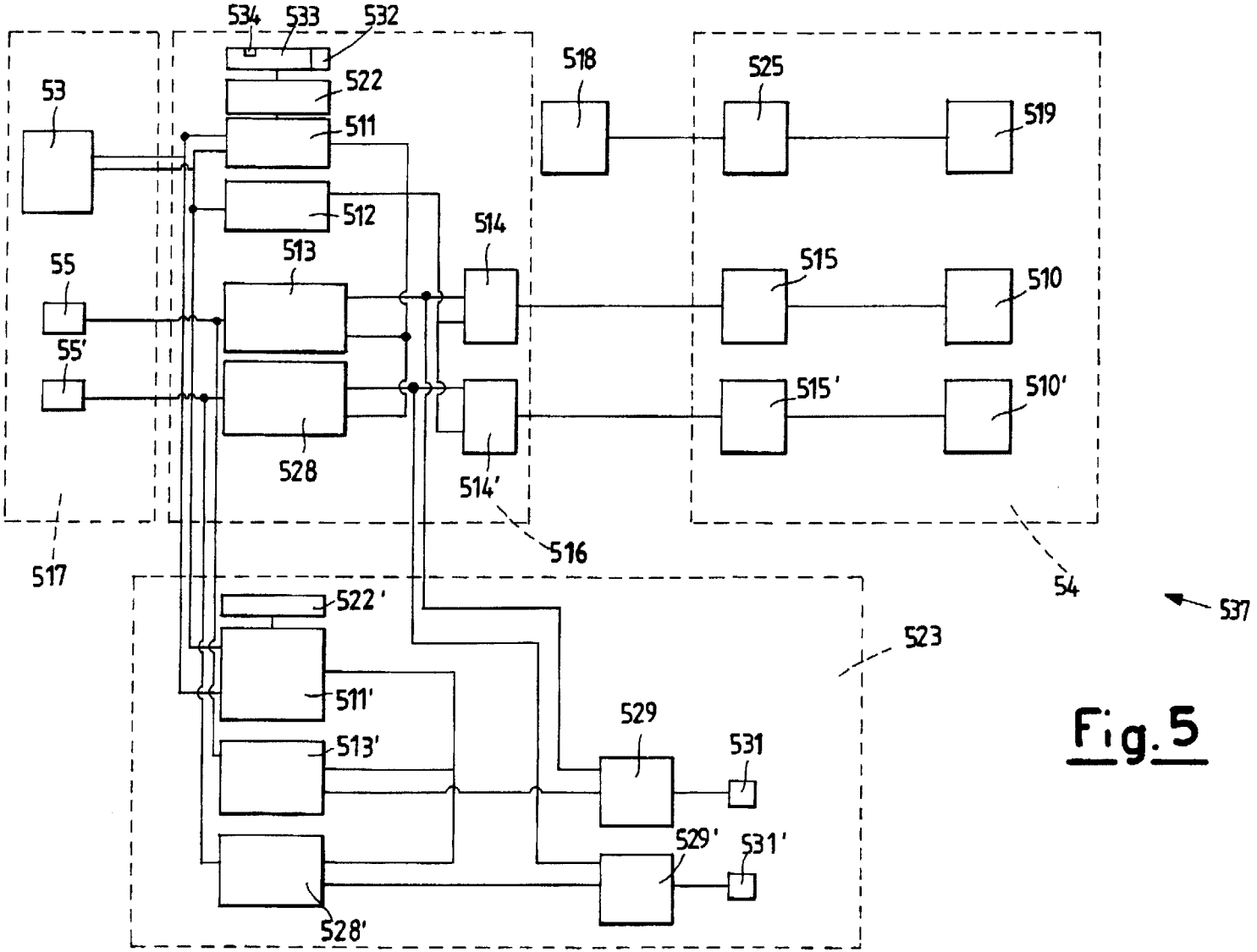
FIG. 5 shows a block diagram of the electric-electronic system of the machine of FIG. 4.

Referring to FIGS. 4 and 5, a second embodiment of a raising machine according to the present invention will be discussed now.

The raising machine, generally indicated by (51), comprises a revolving drum, indicated at (52), on the periphery of which the pile cylinders and the counter-pile processing cylinders, indicated by the reference numerals (57) and (58), respectively, are arranged in a mutually alternating arrangement, and are caused to revolve around their revolution axis (535), while simultaneously revolving around the drum (52).

By the reference numeral (53), an electronic encoder is indicated—referred to, from now on, as the "encoder"—integrally mounted on the drum (52), which converts the analog data corresponding to the angular positions of the drum (52) into digital signals.

The encoder (53) generates a determined number of voltage pulses per each revolution of drum (52). Furthermore, the encoder (53) generates a voltage pulse every time that it runs beyond a reference notch (536) provided on the framework (51') of the machine (51). Such a pulse is commonly referred to as the "zero pulse", because it corresponds to the initial phase of the periodic function which represents the revolution motion of the drum (52).

By (56) and (56'), two cleaning brushes are indicated, each of which is provided with two trimmings, indicated with the reference numerals (520) and (520'), equipped with needles, indicated by with the reference numerals (521) and (521'), acting as cleaning organs inside the trimmings (57') and (58') of the processing cylinders (57) and (58).

The trimmings (520) and (520') are installed on the contours of the brushes (56) and (56'), in such a way that the needles (521) and (521') will enter between the metal points (524) and (524') with which the processing cylinders (57) and (58) are equipped. Each of the cleaning brushes (56) and (56') performs the task of cleaning a determined set of processing cylinders, i.e., the pile cylinders (57), or the counter-pile cylinders (58).

By the numerals (510) and (510'), two electrical motor units are indicated, which transmit motion, through pulleys (59) and (59'), to the cleaning brushes (56) and (56'). By the numerals (55) and (55'), two proximity sensors are indicated which are respectively installed on each of the brushes (56) and (56').

Each of the sensors (55) and (55'), according to whether the sensor is installed on the brush (56) which performs the cleaning of the pile cylinders (57), or the sensor is installed on the brush (56') which performs the cleaning of the counter-pile cylinders (58), detects the passage of the set of corresponding processing cylinders and supplies, for each set of cylinders, an electrical output signal constituted by a set of voltage pulses, i.e., one pulse per each passage of the sensor in front of each relevant processing cylinder.

From the position of zero pulse, relevant to the passage of encoder (53) beyond the reference position (536), inside the electric-electronic system (537) begins, per each drum (52) revolution, the comparison between the phase of the periodical function which represents the revolution motion of both brushes (56) and (56') and the phase of the periodical function which represents the revolution motion of the drum (52), associated with the motion of the processing cylinders (57) and (58).

In particular, referring to FIG. 5, in the block diagram of the electric-electronic system (537) of the machine the following elements can be located:

- a detector unit (517) constituted by the encoder (53) and both proximity sensors (55) and (55'), which converts the analog signals corresponding to the angular positions of the drum (52) and of the brushes (56) and (56') into digital signals to be sent to an electronic measuring unit (516);
- an electronic measuring unit (516) which collects and processes said digital signals, constituted by a programmable frequency divider (511), equipped with an electronic module (522) for input data entering [through the keyboard (533)], a frequency-to-voltage converter (512), two comparators (513) and (513') and two adder devices (of the type equipped with operational amplifiers) (514) and (514');

an electrical driver unit (54) constituted by two driver circuits (515) and (515') (each of which is referred to, from now on, as "driver"), by three electrical motor units (510), (510') and (519) which drive the cleaning brush (56), the cleaning brush (56') and the drum (52), respectively, and a pilot circuit (525) which drives the electrical motor unit (519) of the drum (52);

a power supply unit (518) which controls the pilot circuit (525); and an electronic control circuit (523) which watches for the actual presence of the electrical signals generated by the encoder (53) and the proximity sensors (55) and (55') and, based on them, verifies the preservation of the desired phase synchronism.

In particular, the reference numeral (511) indicates a frequency divider constituted by binary circuits and programmable by means of an electronic module (522), which makes it possible such data to be entered through a keyboard (533), as the number of divisions of frequency of signals coming from encoder (53) and the number of processing cylinders (57) and (58) present on drum (52).

The electronic module (522) automatically calculates the "synchronism positions", i.e., the angular positions of encoder (53) relative to a radial reference axis (538) (which, in the illustrated case, is also vertical). At those positions, the electric-electronic circuit (537) verifies and possibly corrects the phase shift between the revolution motion of the drum and the revolution motion of the brushes in order to preserve the necessary synchronism.

In practice, the corresponding angle to each synchronism position is equal to the ratio of the whole round angle to the number of processing cylinders (57) and (58) present in the raising machine (51). As the number of the cylinders (57) and (58) usually is 16, 24 or 36, the value of the angle will be comprised within the range of from 10 to 20 degrees.

Furthermore, the electronic module (522) is provided with a liquid crystal display (532) which displays the data when the latter are entered by the user through the keyboard (533), and furthermore displays the possible synchronism error between the phase of the drum (52) and of the brushes (56).and (56').

If a synchronism error is detected, an acoustical alarm signal is simultaneously enabled. The operator is thus given the possibility of evaluating the extent of such an error and of actuating, or less, based on the result of such an evaluation, the drivers (515) and (515)' (On the keyboard (533) an option key can be provided in order to select the drivers (515) and (515') enabling/disabling modalities.), or of not taking this alarm into consideration, in at all particular moments, such as, e.g., machine (51) starting-up or stopping transients when the implied inertias can cause phase errors which are larger than those errors which can be detected during normal steady-state machine (51) running and which, however, do not cause any particular damages owing to the low operating speed and the short time interval during which they occur.

The digital signal constituted by voltage pulses, generated by the encoder (53) and corresponding to the passage of the encoder (53) before each position of synchronism relatively to the radial reference axis (538) is sent to the input of the programmable divider (511).

To the input the zero pulse, i.e., the voltage pulse generated by the encoder (53) at its passage before the reference notch (536) is sent as well.

The digital signal corresponding to the synchronism positions generated as the output signal from the programmable divider (511) is sent to a first phase comparator (513) which compares the phase thereof to the phase of signal coming from sensor (55) installed on brush (56) and to a second phase comparators (528) which compares the phase thereof to the phase of signal coming from sensor (55') installed on brush (56').

Each error detected during the comparison processes is added, with its algebraic sign, through the adder devices (514) and (514'), to a baseline reference value for drum (52) angular speed. The reference signal is an electrical voltage signal and is derived either from the encoder (53), installed on the drum (52), by means of the frequency-to-voltage converter (512) which converts the frequency of the digital signal corresponding to the synchronism positions into a voltage signal, or by means of a tachometrical generator (not shown in the drawings also integral with the drum (52).

Both so-corrected output signals from both adder devices (514) and (514') are respectively sent to both drivers (515) and (515') which feed both electrical motor means or motors (510) and (510'), driving the cleaning brushes (56) and (56'), with power.

The baseline reference signal for drum angular speed displays a first portion during which the angular speed increases with time according to a directly proportional trend (i.e., during the time period immediately following machine start-up), then a second portion during which the angular speed remains constant (steady-state machine operation), then, finally a third, decreasing-speed portion, which starts when power supply to the machine is switched off and lasts until the drum (52) eventually stops.

The algebraic addition operation of such baseline reference signal to the signal coming from each of comparators (513), (528) is necessary in order to check the sensibility of the system and prevent that, at any extremely small phase error between the drum (52) and the brushes (56) and (56'), the electronic measuring unit (516) commands anyway the enabling of the electrical motor means (55) and (55').

The reference numeral (523) indicates an electronic control circuit which checks that the digital output signals from the encoder (53) and the proximity sensors (510) and (510') are actually present.

In practice, this function is obtained by taking the output signals from the encoder (53) and the proximity sensors (55) and (55') and performing a further phase comparison, at all analogous to the preceding one. In fact, a programmable divider (511') to the input of which the same signals are sent which come from the encoder (53) and the proximity sensors (55) and (55'); an electronic module (522') which divides the frequency of said signals and is entered as the electronic module (522); and two phase comparators (513') and (528'), to the input of which the signals are sent which come from the divider (511') and, respectively, the proximity sensors (55) and (55'), are used.

The output signals from the phase comparators (513) and (528') are sent each to a Schnitt trigger comparator (529) and (529'), at the input of which also the signal which comes from the phase comparator (513) and the signal which comes from the phase comparator (528), respectively, are present.

The Schmitt triggers (529) and (529') perform a comparison between the input signals and, if differences between the signals are detected, enable an alarm visual and sound signalling procedure, by means of the devices (531) and (531'), e.g., piezoelectric buzzers or LED diodes. If, due to any reason, the encoder (53) and/or the proximity sensors (55) and (55') do not supply output signals or supply them improperly, the control circuit (523) detects such signal lack/error in order to secure a better measurement reliability.

The control circuit (523) is structurally similar to the electronic measuring unit (516) and can therefore be easily reproduced based on electronic unit (516). In that way, the overall manufacturing costs can be reduced.

A further advantage offered by the present invention is the possibility the raising machines manufacturer is given, of standardizing its production by installing the same electric/electronic system (537), without any modifications and/or adjustments, on machines of the type indicated with (51), having a different number of processing cylinders (57) and (58). In fact, it is enough that the user enter the number of processing cylinders (57) and (58) by means of the keyboard (533) of the electronic module (522).

Another drawback observed in the raising machines (51) known from the prior art, is the impossibility of submitting the metal points (524) and (524') of cylinders (57) and (58)—which are known to show only seldom a same wear rate—to a differentiated sharpening operation.

On the contrary, in the raising machine (51) according to the present invention, as the movement of drum (52) can be made independent from the movement of brushes (56) and (56'), the metal points (524) and (524') of each preselected processing cylinder (57) or (58) can be sharpened by operating on it, with drum (52) being stationary and brushes (56) and (56') being kept moving, until the end of the sharpening process which, obviously, implies that the revolution motion of cylinder (57) or (58) around itself continues, as driven by auxiliary means (not shown), like, e.g., a revolving chuck.

Finally, it is important to remark that, by operating in that way, a specific action of desired duration is obtained of the cleaning brush (56) or (56') on the metal points (524) or (524') of the processing cylinder (57) or (58), with a particularly effective sharpening being consequently obtained.

Furthermore, such a sharpening method offers a number of other advantages, such as:

the angular speed of the cleaning brush (56) or (56') can be adjusted as a function of effectiveness and, therefore, a time saving during this step is obtained;

the fabric need not be removed from machine (51) and therefore the dead times are avoided which are due to operation interruption and to fabric installation on the rollers before re-starting the drum cleaning the processing cylinders (57) and (58) and sharpening the metal points (524) and (524') can be automatically carried out during the needed time for drum (52) to revolve by one single revolution; and the average life of the trimmings (57') and (58') which contain the metal points (524) and (524') is longer than the average life of the trimmings (57') and (58') submitted to a traditional sharpening operation. In fact, traditionally, upon considering the necessary time for unloading the raising machine (51) and the impossibility of sharpening a predetermined set of processing cylinders (57) or (58), the users prefer to use the trimmings (57' and 58') until their wear threshold, and then replace all of them. Unfortunately, after such a replacement, the freshly installed trimming (57') or (58') requires a some-days-long break-in run during which the fabric is not perfectly processed.

All these time wastes resulting eventually in missed production or fabric quality lowering, can be prevented by systematically operating according to the modalities provided according to the present invention.

Clearly, many changes may be supplied by those skilled in the art to the raising machine according to the present invention, without departing from the scope of protection of the inventive idea, and, clearly, when practicing the invention the shapes of the illustrated details can be different, and same details may be replaced by technically equivalent elements.

For example, for particular fabric types and/or processes, reversing the direction of revolution of drum (13) or (52) of the machine (and, consequently, of the pile or counter-pile processing cylinders (16, 57) or (17, 58), respectively, could become necessary. In that case, both cleaning brushes (21 or 56) and (22 or 56') will operate on the other cylinder set opposite to the cylinder set on which they were operating before revolution direction reversal.

If the toothed-belt/sprockets or gear wheels transmission known from the prior art are adopted, the only possible system for that purpose consists in introducing a mechanical phase shift by means of a clutch engagement/disengagement device additionally to the torque limiting coupling.

On the contrary, if the solution according to the present invention is adopted, it is enough that a switch (534) purposely installed on the keyboard (533) or in the electronic control system (523) or, anyway, in the electric/electronic system (537) be switched, which shifts the signal by the desired phase.

What is claimed is:

1. An automated pile-raising machine for fabric, comprising:

a carrier structure;

at least one drum mounted for rotation on a shaft;

a respective first motor arranged to rotate each said drum about the longitudinal axis of the respective said shaft;

each said drum carrying two mutually alternating sets of raising cylinders respectively arranged to operate in a pile mode and in a counter-pile mode; said raising cylinders being arranged so as to be radially outwardly effectively coincident with respective generatrices of the respective said drum;

for each said drum, two mutually independent drive means arranged for rotating all of the cylinders of each respective set of raising cylinders, about the longitudinal axis of the respective ones of said raising cylinders, in respective directions;

for each said drum, a pair of rotating brushes arranged for cleaning the respective ones of said raising cylinders;

for each said drum, a second motor arranged for rotating one of the brushes of the respective said pair of rotating brushes, and a third motor arranged for rotating the other of the brushes of the respective said pair of rotating brushes;

an electrical-electronic system operatively associated with each said first motor, each said second motor, and each said third motor;

said electrical-electronic system including, in operatively associated relation:

a detection unit;

an electrical driver unit;

a power supply for each said drum;

an electrical measuring unit; and an electronic control circuit;

said detection unit comprising a plurality of sensors which read, instant-by-instant, the angular position of said at least one drum and said brushes so as to check the correct timing between each said drum and the respective said brushes, said brushes being arranged to disengage respective one of said raising cylinders when a phase shift occurs.

2. An automated pile-raising machine according to claim 1, wherein:

said electrical driver unit is constituted by a respective driver element associated with each said motor.

3. An automated pile-raising machine according to claim 1, wherein:

said electronic measuring unit is arranged to cause, based on the data coming from said sensors, feeding of said first, second and third motors, respectively with power to be enabled so that each said drum, raising cylinder and brush is rotated, with all of them retaining respective phase differences requisite for raising operations to be performed on cloth by said machine.

4. An automated pile-raising machine according to claim 2 wherein said electronic measuring unit is constituted by:

a programmable frequency divider comprising a keyboard and a display device respectively arranged to enter and display data, to an input of which digital signals are arranged to be sent from said sensors and output digital signals from which are arranged to be sent to a first comparator device and a second comparator device;

at least two adder devices arranged to send output signals thereof respectively to inputs of said driver elements associated with said brushes;

a frequency-to-voltage converter to an input of which first ones of said digital signals, which come from said sensors and respectively correspond to each of a plurality of angular positions of each said drum relative to a radial reference axis are arranged to be sent and providing an output signal which is arranged to be sent to a first input of each said adder device;

said first and second comparator devices having respective inputs each arranged to receive a digital signal coming from a respective at least one of said sensors, and having respective outputs arranged to send respective output signals to a second input of each said adder device.

5. An automated pile-raising machine according to claim 1, wherein:

said electronic control circuit is arranged to check for actual presence of digital signals coming from said sensors and, based on presence thereof, to calculate respective phase differences of functions of said automated pile-raising machine relevant to said signals.

6. An automated pile-raising machine according to claim 5, wherein said electronic control circuit comprises:

a programmable frequency divider associated with an electronic module to an input of which digital signals are arranged to be sent which come from one of said sensors and output digital signals from which are arranged to be sent to a first comparator device and a second comparator device;

at least one said first comparator device and at least one said second comparator device to respective inputs of which a respective said digital signal coming from at least one said sensor, and a respective said digital signal coming from another said sensor are respectively arranged to be sent, and output signals from which are respectively arranged to be sent to a third comparator device and a fourth comparator device, respectively;

at least one said third comparator device and at least one said fourth comparator device to respective inputs of which digital signal output coming from a said first comparator device of said electronic measuring unit, and digital signal output coming from a said second comparator device of said electronic measuring unit are respectively arranged to be sent, and output signals from which are arranged to be sent to at least one signalling means;

at least one said signalling means of at least one of acoustical type and visual type, which is arranged to start operating when at least one of the digital signals present at the input of said electronic measuring unit is different from at least one of the digital signals present at the input of said electronic control circuit.

7. An automated pile-raising machine according to claim 1, wherein:

at least one of said sensors is an electronic encoder which is arranged to convert analog data corresponding to angular positions of a respective said drum relative to a radial reference axis, into first digital signals and to generate a second digital signal every time said encoder runs beyond a determined defined position provided on said carrier structure of said machine.

8. An automated pile-raising machine according to claim 1, wherein:

said sensors are respective electronic proximity sensors which are respectively arranged to detect the passage of respective cylinders of a first said set and a second said set of said raising cylinders, and to supply, for each said passage, a respective said digital signal.

9. An automated pile-raising machine according to claim 2, wherein:

said each driver element is arranged to supply with power the respective said first, second and third motor.

10. An automated pile-raising machine according to claim 4, wherein:

said first and second comparator devices are arranged to perform comparison operations on the phases of machine functions relevant to the signals present at the respective inputs thereof.

11. An automated pile-raising machine according to claim 4, wherein:

each said third comparator device is constituted by a respective Schmitt trigger which is arranged to compare the digital signals input thereto and produce, as the output thereof, two logic signals which are different according to whether said input signals are the same, or less.

12. An automated pile-raising machine according to claim 4, wherein:

said adder devices each include at least one operational amplifier.

13. An automated pile-rising machine according to claim 6, wherein:

each said signalling means is constituted by at least one of a piezoelectric buzzer and an LED diode.

14. An automated pile-raising machine according to claim 1, wherein:

each said pair of brushes is arranged on a respective swinging plate and is provided with a positive transmission between the brushes of the respective said pair.

15. An automated pile-raising machine according to claim 14, wherein each said plate is hinged onto said carrier structure and a respective driver is provided therefor and arranged to cause the respective said plate to swing from a first position in which the respective said brushes are positioned into engagement with respective ones of said raising cylinders and a second position in which the respective said brushes are disengaged and spaced apart from said raising cylinders.

16. An automated pile-raising machine according to claim 1, wherein:

for each said drum, there are three said sensors including a first sensor arranged to detect the angular position of said shaft of the respective said drum and two sensors arranged to detect the angular positions of the brushes of the respective said pair of brushes.

17. An automated pile-raising machine according to claim 16, wherein:

said sensors are operatively connected with said electric-electronic system so as to enable reversibility of operation of said machine to be automatically accomplished.

18. An automated pile-raising machine according to claim 1, wherein:

each said motor is a stepper motor.

19. An automated pile-raising machine according to claim 1, wherein:

each said motor is a brushless motor.

20. An automated pile-raising machine according to claim 1, wherein:

each said motor comprises an inverter.

21. An automated pile raising machine according to claim 1, wherein:

said machine is a double-drum machine in which said at least one drum is constituted by two drums.

22. An automated pile-raising machine according to claim 20, wherein:

one of said two drums is superimposed on the other of said two drums.

23. An automated pile-raising machine according to claim 14, wherein:

each said positive transmission comprises:

a toothed belt winding around two pulleys each of which is integrally mounted on shafts respectively mounting the brushes of a respective said pair of brushes and a third pulley which performs adjustment of tension of said toothed belt and winds around both of said two pulleys on opposite sides thereof, so as to cause the brushes of the respective said pair of brushes to rotate in mutually opposite directions.

24. An automated pile-raising machine according to claim 14, wherein:

each said positive transmission comprises two gear wheels interacting with each other and respectively being integral with shafts of the brushes of a respective said pair of brushes.

* * * * *